US005188220A

United States Patent [19]

Schmitt-Walter

[11] Patent Number: 5,188,220

[45] Date of Patent: Feb. 23, 1993

[54] ILLUMINATED PUSH-BUTTON SWITCH

[76] Inventor: Stefan Schmitt-Walter, Jägerstrasse 7b, 8024 Diesenhofen, Fed. Rep. of Germany

[21] Appl. No.: 649,010

[22] Filed: Jan. 31, 1991

[30] Foreign Application Priority Data

Feb. 2, 1990 [DE] Fed. Rep. of Germany ... 9001186[U]

[51] Int. Cl.[5] ..... H01H 9/00; H01H 13/70

[52] U.S. Cl. ..... 200/313; 200/314; 200/343

[58] Field of Search ..... 200/313, 343, 314, 341, 200/331, 332

[56] References Cited

U.S. PATENT DOCUMENTS

| | | | |
|---|---|---|---|
| 3,767,881 | 10/1973 | Sharples | 200/332 |
| 4,016,388 | 4/1977 | Golbeck et al. | 200/314 |
| 4,017,700 | 4/1977 | West | 200/314 |
| 4,135,073 | 1/1979 | Kobayashi | 200/313 |
| 4,163,883 | 8/1979 | Boulanger | 200/314 |
| 4,225,766 | 9/1980 | Pfeifer et al. | 200/314 |
| 4,293,764 | 10/1981 | Amrhein | 200/314 |
| 4,582,967 | 4/1986 | Brumit et al. | 200/343 X |
| 5,087,802 | 2/1992 | Guilleminot | 200/341 |

FOREIGN PATENT DOCUMENTS

| | | | |
|---|---|---|---|
| 1496640 | 12/1977 | United Kingdom . | |
| 1549900 | 8/1979 | United Kingdom . | |
| 2053574 | 2/1981 | United Kingdom | 200/314 |
| 2085230 | 4/1982 | United Kingdom | 200/314 |

OTHER PUBLICATIONS

Jun. 10, 1992 Mitteilung Anhang Zum Europaischen Recherchenbericht Uber Die Europaische Patentanmeldung Nr. and Europaischer Recherchenbericht EP 90 12 5276.

*Primary Examiner*—Henry J. Recla
*Assistant Examiner*—David J. Walczak
*Attorney, Agent, or Firm*—Finnegan, Henderson, Farabow, Garrett & Dunner

[57] ABSTRACT

An illuminated push-button switch having a touch element is disclosed, the touch element comprising a lever which is adapted to be moved relative to a support plate in which it is supported on the support plate. A light source is arranged below the touch element, the touch element further being provided with a light exit opening. A simple association of the touch element and the light source associated therewith is thereby provided, the combination having not only improved operability, but also improved ease of maintenance.

12 Claims, 1 Drawing Sheet

ILLUMINATED PUSH-BUTTON SWITCH

TECHNICAL FIELD

The present invention refers to an illuminated push-button switch for rear mounting in an operating panel, comprising a support plate, which has arranged thereon a switching means for triggering a switching operation, a touch element for operating said switching means and a light source for checking said switching operation.

PRIOR ART

Such operating panels are used for effecting control and automatic control in connection with switchboards or electric or electronic machines. In most cases, the operating panels have a modular structural design so as to facilitate adaptation or extension, and in some cases such operating panels are also constructed as portable panels.

The faces of such operating panels have arranged therein a large number of touch elements and light sources. The majority of the light sources are associated with the touch elements for optically checking the switching operations triggered by said touch elements. Hence, the touch elements and the associated control light sources are arranged close to one another, e.g. below one another or side by side.

In the case of an operating panel having a large number of touch elements with complementary light sources, an adequate legend for describing the function must be provided for characterizing the switching operations triggered by the touch elements. If, in this connection, the touch element and the associated light source are not unequivocally associated with each other in space, both said components will have to be provided with an adequate legend.

Furthermore, it is disadvantageous that an exchange, which may become necessary due to failure or due to the fact that a different colour of a light source arranged on such a support plate is chosen, can be carried out only in a comparatively complicated manner.

The whole face of the operating panel is covered with an electrically non-conductive foil of plastic material so that an exchange of the light source from the front necessitates that the foil is detached, that the light source is exchanged and that, subsequently, the foil is fixed again. In addition to the amount of work required for detaching and fixing the foil, there is also the risk that the foil may be damaged whereupon it will have to be replaced.

Exchange of the light source from the back is only possible when the whole support plate with all the parts arranged thereon is removed so as to gain access to the light source. In order to do this, it may be necessary to detach several electric contacts, and this means a lot of work. There is also the risk that the electric components may be damaged or connected incorrectly.

Another disadvantage is that, in the case of direct actuation, the switching means, which is operated by the touch element, may have a pressure point which is too soft. An adaptation of simple, commercially available and economy-priced switching means to a higher pressure point is in most cases so complicated that it is not worth the effort. In addition, the stroke of the touch element, which is necessary for triggering the switching operation, e.g. in the case of pressure switches, has normally been neither adjusted nor adapted up to now.

SUMMARY OF THE INVENTION

Hence, the present invention is based on the task of guaranteeing, in the case of an illuminated push-button switch of the type mentioned at the beginning, a simple association of the touch element and of the light source belonging thereto, in combination with improved operability and with improved ease of maintenance.

In the case of an illuminated push-button switch having the features of the invention, this task is solved by the features that the touch element is constructed as a lever which is adapted to be moved relative to the suport plate and which is supported on said support plate, and that the light source is arranged below the touch element, said touch element being provided with a light exit opening.

DETAILED DESCRIPTION

Figure 1:
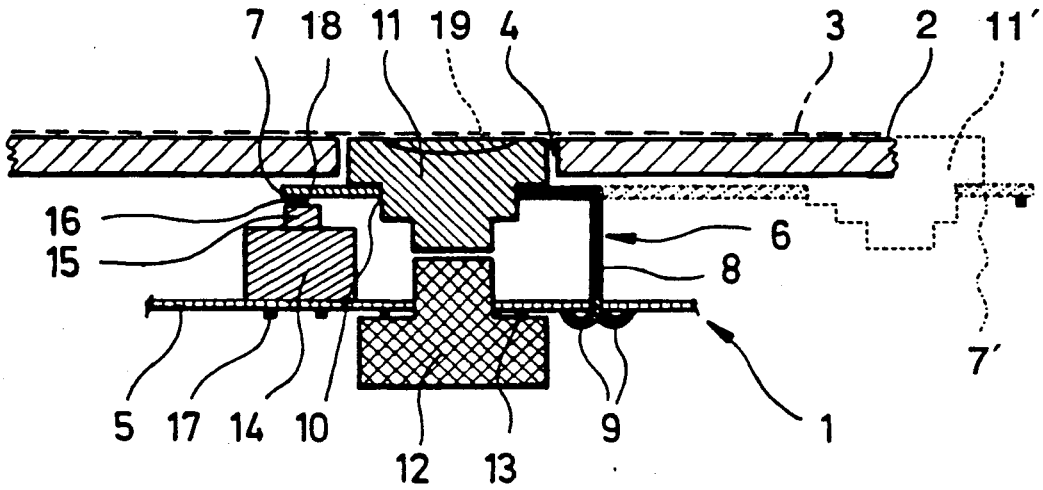
FIG. 1 shows a side view of the illuminated push-button switch according to the invention in a condition in which it is installed in an operating panel.

The arrangement of the light source below the touch element, which is to be marked by said light source, shows advantages in many respects. It is not necessary to provide in the operating panel any additional openings for the light sources which are required for checking the control operation triggered by the touch elements. Moreover, additional marking, which was sometimes necessary in cases in which the touch element and the light source were separate components, can be dispensed with. The checking of the switching operation is thus made optically visible directly in the touch element. The switching-on and switching-off operations are unequivocally associated with the touch element due to the optical marking. This has the effect that the operating panel as a whole will be easier to survey and less operating errors will be made. A larger number of illuminated push-button switches can be integrated in the operating panel while guaranteeing safe operation at the same time.

It is possible to easily exchange the light source from the back for the purpose of installing a light source having a different colour or for the purpose of exchanging a defective light source. It is no longer necessary to remove the whole support plate with all the components attached thereto, since the light source is accessible directly in the support plate.

Due to the fact that the touch element is constructed as a lever, e.g. a shorter stroke of the touch element can trigger the switching operation, when a suitable length of the lever arm is chosen. It is also possible to change in the case of "normal" switches the pressure which is required for triggering the switching operation. Incidental switching, which may already be caused by slightly touching the touch element, is thus made less likely, since the pressure point of the switching element is increased by the simple mechanical aid constituted by the lever. By skillfully selecting the lever, it is thus possible to reduce the stroke of the push-button and to increase the pressure point at the same time.

Furthermore, it will be advantageous when the lever is constructed as a lever which is supported at one side thereof. The function of the lever can thus be utilized with the minimum possible space requirement, since one lever arm having an adapted length will be sufficient.

In order to arrange the touch element such that it is flush with the surface of the operating panel, it will be advantageous when the lever is constructed as an L-shaped angle. In this case, one arm of the L-shaped angle is arranged parallel to the surface of the operating panel, and said arm is accessible from the front of the operating panel as a touch element.

In this connection, it will additionally be advantageous when said L-shaped angle is provided with one shorter arm and with one longer arm. If, for example, the longer arm is associated with the surface of the operating panel, the support plate can be arranged at a small distance from the operating panel surface. A space-saving, compact structural design is thus obtained.

When the lever has its shorter arm supported such that it extends at right angles to the support plate, an advantageous, simple parallel arrangement of the support plate and of the operating panel surface is obtained. On the whole, it is thus possible to install the touch element and all the other components arranged on the support plate in the operating panel from behind, in accordance with the modular mode of construction of other electronic devices provided e.g. with plug-in cards.

A structurally simple solution is provided by the feature that, by means of two tongue-like extensions, the shorter arm is clamped in position in openings provided in the support plate and adapted to said extensions. In this way, the L-shaped angle of the touch element can be supported on the support plate in an extremely simple manner. Moreover, such a connection can easily be established, since it does not require any additional aids.

In the case of one advantageous embodiment, the light exit opening is arranged in the longer arm above the light source. It is thus guaranteed that the maximum possible amount of light of the light source falls in the direction of the operating panel, and this will have the effect that the switching operation is optically well marked so as to be recognizable from outside.

A transparent push-button, which cannot be moved relative to the arm and which is arranged in the light exit opening is an advantageous further development in the present connection, since a push-button will facilitate the operation of the touch element. The light exit opening is covered by the push-button so that the light source can now be arranged such that it is located directly opposite to an opening in the operating panel, the shape of the light exit opening being adapted to the size of the light source.

In this connection, it will then be advantageous when the push-button projects beyond the surface of the longer arm above the light exit opening. It will also be advantageous when, said push-button has a larger, especially circular cross-section in comparison to said light exit opening as well as when, below the light exit opening, said push-button is constructed such that it has the shape of a stepped cylinder and covers the light source fully. On the basis of this special shape of the push-button, almost the whole light of the light source can be passed on to the operating panel, since the push button is constructed such that it conducts the light mainly in one direction.

It will be advantageous when the longer arm is arranged such that it abuts on the operating panel from behind and when the operating panel is provided with an opening, which is adapted to the cross-sectional surface of the push-button, so that the touch element with the push-button are accessible in the easiest possible way from the face of the operating panel. The push-button is constructed such that it is arranged flush with the surface of the operating panel face. It is thus possible to operate the push-button in an advantageous manner, and, in addition, good optical control can be effected from the outer side of the operating panel due to the manner in which the light source is arranged relative to the push-button.

In the case of an additional embodiment, it will be advantageous when the switching means is provided with a spring element, which has arranged thereon the touch element, said spring element being adapted to be used for triggering the switching operation when it is in its biased condition. Due to the arrangement of the touch element on the spring element of the switching means, the switching operation can be triggered in a simple manner by actuating the push-button. By an appropriate selection of the lever arm, it will also be possible to vary the pressure point of the switching means and to adjust the stroke of the push-button. Due to the elastic support on the spring element, the push-button can automatically be returned to its starting position in the operating panel.

It will be advantageous when the longer arm of the touch element has its free end arranged on the spring element of the switching menas so that the lever action of the touch element can be utilized with the least possible space being required and so that a compact structural unit of light source, touch element and switching means is obtained.

In this connection, it will be an additional advantage when the end of the longer arm resting on the switching means is provided with a pin, which engages an adequate recess of the switching means and which is adapted to be moved relative thereto. This pin constitutes an additional safety means guaranteeing the connection between touch element and switching means. The touch element is thus fixed at a second point, in addition to the fixing provided by the support of the lever on the support plate.

In order to improve actuation of the push-button, it will be advantageous when the surface of the push-button is adapted to the form of a finger tip.

In this connection, it will additionally be advantageous when the push-button is constructed as a collective lens. The maximum possible amount of light of the light source can thus be supplied to the operating panel in a simple manner for optically checking the switching operation.

In order to make—also without removal of the support plate—e.g. the light source easily exchangeable for a different light source, either for the purpose of inserting a different colour or for the purpose of replacing a defective light source, it will be advantageous when at least the light source can be exchanged from the back of the support plate. The support plate will then be provided with an opening, which corresponds to the light source and which is arranged directly below the push-button. The light source can thus be advanced to the underside of the push-button and it can, for example, be constructed such that it is adapted to be attached to holding pins provided on the support plate side facing away from the push-button. If the switching means is not of the exchangeable type, its contact terminals extend through to the back of the support plate where they can be connected to appropriate electric leads.

In the case of an advantageous further development of the present invention, a second arm, which corresponds to the longer arm of the touch element and which extends diametrically thereto, is arranged on said shorter arm such that it is essentially perpendicular thereto, a switching means and a light source being arranged below said second arm in a corresponding manner. It is thus possible to realize, in very close spatial relationship, two different touch elements according to the present invention while making use of one common shorter arm of the L-shaped lever, said shorter arm being supported on the support plate. Due to the elasticity of the lever, it is even possible to actuate both interconnected push-buttons at the same time.

Embodiments of the present invention will be described hereinbelow on the basis of a drawing, in which FIG. 1 shows an illuminated push-button switch according to the present invention, which is provided with reference numeral 1 as a whole. The push-button switch 1 is installed in an operating panel 2 from behind. Only a small part of said operating panel 2 is visible. Normally, such operating panels 2 have a box-type structural design and they are adapted to be partially enlarged in a modular fashion or to be enlarged or modified with regard to their function by means of various plug-in units. The face of such an operating panel has arranged thereon a large number of touch elements and indicator lamps. They serve to effect control and automatic control of normally electrical means. The face of the operating panel 2 is fully covered by a foil 3. This foil 3 is non-conductive, and it serves to provide electrically safe operation as well as protection against possible contamination and protection against moisture.

The illuminated push-button switch 1 according to the present invention is arranged in an opening 4 of the operating panel 2. Said push-button switch 1 includes a support plate fabricated from an insulating material. The material used is, for example, plastic material, but it is also possible to use other embodiments, such as compound materials, e.g. sandwich plates consisting of glued and pressed foils. Such plates are often used for mounting electric or electronic components. They are easily machinable so that it is possible to provide therein holes for passing contacts therethrough and also passage means for fixing connector pins, which are glued in position in the plate. Additionally, support plates of this type are comparatively resistant to bending and they are also very thin.

The support plate 5 has arranged thereon an L-shaped angle 6. The angle 6 is supported on the support plate 5 at one side thereof and its structural design is similar to that of a lever. In view of the fact that the angle 6 is not in direct contact with electric lines or components, it can be made from metal, such as aluminum, or from plastic material. In order to achieve a lever action, the L-shaped angle 6 is supported on the support plate 5 at one side thereof via a shorter arm 8. The connection between the support plate 5 and the arm 8 of the L-shaped angle 6 can be established e.g. by means of glueing. In the case of the present embodiment, the arm 8 is provided with two extensions 9, which are passed through appropriate openings of the support plate 5 and which are folded in opposite directions on the underside of said support plate 5. It is thus possible to establish a simple, solid connection.

The whole L-shaped angle can simply be sawn out or, and this would be even more simple, stamped out of an aluminum plate, for example, in such a way that the required shape including the extensions 9 is directly obtained. The shorter arm 8 can be bent in an additional working cycle. The light exit opening 10, which is arranged in the longer arm 7, can have an arbitrary shape, a circular cross-section being, however, the most advantageous one. Also the light exit opening 10 can immediately be produced e.g. during the stamping process. A push-button 11 is arranged in the light exit opening 10. The push-button is light-transmitting and it can be fabricated e.g. from glass or simply from a transparent, hard plastic material. In cases in which the light exit opening 10 has a circular shape, it will be advantageous when the push-button 11 has a circular shape as well. The push-button 11 can simply be produced by sawing off from a plastic rod having an appropriate diameter. It is, however, also possible to produce said push-button by turning a thicker rod to size until the necessary diameter is obtained. The circular cross-section of the push-button 11 is adapted to the opening 4 of the operating panel 2. In the direction facing away from the operating panel 2, the cross-section of the push-button is stepwise reduced in size. One step is formed such that, fitting the light exit opening 10, the lower part of the push-button 11 is adapted such that it rests on the L-shaped angle 6. The push-button 11 is fixed in the light exit opening simply by means of glueing.

The side of the push-button 11 facing away from the operating panel 2 is adapted to a light source 12 arranged below said push button 11 via an additional stepwise reduction of cross-section. The light source 12, which is, for example, an LED-lamp or a similarly small, effective light source, is available at a reasonable price in various colours. The light exit side of said light source extends through an adapted opening in the support plate 5 up to a point which is located very close to the lower end of the push-button. Commercially available light sources 12 of this type are provided with two or more holes with the aid of which said light source 12 can be attached to appropriate pins 13. These 13 are arranged in the support plate 5, and the light source can simply be attached thereto from the rear side of the support plate 5.

The free end of the long arm 7 of the L-shaped angle 6 has a switching means 14 arranged belot it. In the present connection, it will be advantageous to use a pressure switch, which triggers an electric switching operation by simple pressing of a press button 15. The switching means 14 is, in the present case, constructed as a mechanical, almost chatter-free switch having a defined pressure point for switching on and off. The illuminated push-button switch 1 according to the present invention can have inserted therein e.g. a so-called click switch as switching means 14.

Between the longer arm 7 of the L-shaped angle 6 and the switching means 14, a connecting pin 16 is arranged, which engages an adequate opening of the press button 15 of the switching means 14 below the longer arm 7 at the free end of said arm. The connecting pin is arranged on and fixed to the end of the arm 7 in a manner resembling e.g. a rivet. Below the switching means 14, the electric contacts 17 are passed through and adapted to be connected to appropriate electric leads e.g. by means of soldering.

In FIG. 1, a recess 18 is illustrated in a press button 15 of the switching means 14, whereby connecting pin 16 is partially inserted in recess 18. Moreover, a curved surface 19 of push-button 11 and a second arm 7' and a second push-button 11' both diametrically arranged to longer arm 7 and push-button 11 are represented by the dashed lines.

Figure 2:
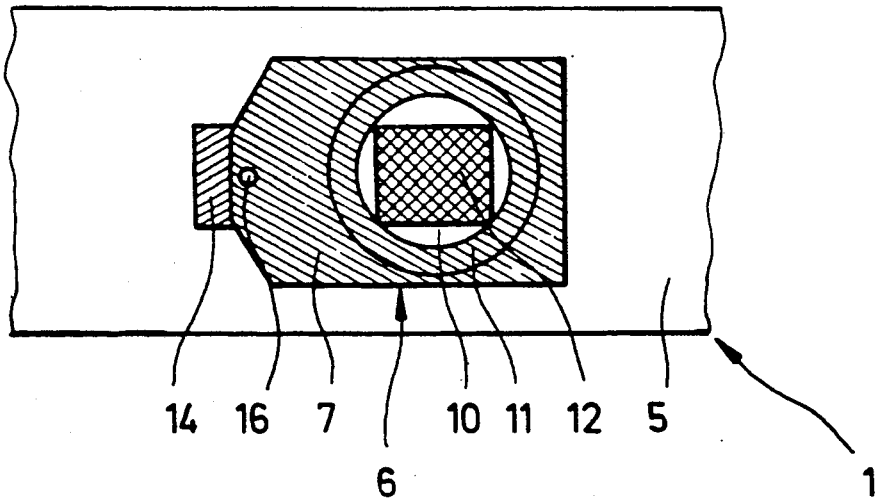
FIG. 2 shows a schematic top view of an illuminated push-button switch according to the present invention.

FIG. 2 shows a top view of the illuminated push-button switch, which is provided with reference numeral 1 as a whole, in the non-installed condition. On the support plate 5, the switching means 14 is visible, partially covered by the longer arm 7 of the L-shaped angle 6. Above the switching means 14, the connecting pin 16 is arranged, said connecting pin 16 being secured in position in the arm 7. The arm 7 has a substantially rectangular structural design, the free end, which is located above the switching means 14, being bevelled by partially removing the edges. In the direction of the other end of the arm 7, the light exit opening 10 is arranged. It has an essentially circular cross-section. The transparent push button 11, which has a larger diameter than the light exit opening 10, is arranged in said light exit opening 10 concentrically therewith. The diameter of the push button 11 is chosen such that it does not project beyond the rectangular arm 7.

The light source 12, which can be seen through the push button 11, is arranged below the light exit opening 10. In the present case, the light source 12 has an essentially square cross-section, which is adapted to the light exit opening 10.

The illuminated push-button switch 1 according to the present invention can be used for simple mounting in an operating panel flush with the surface of said operating panel. The provision of the push-button on an L-shaped lever, which is supported at one side thereof, has the effect that the pressure point of the switching means can be increased and that the push-button stroke can be reduced at the same time. Moreover, the light source, which can be attached to the support plate directly below the push-button, permits in the case of the present invention optical checking of the switching operation directly by illumination of the push-button. In addition, in the case of defects or for the purpose of replacing the illumination colour by a different light source, the attachable light source can easily be exchanged without removing the support plate.

What is claimed is:

1. An illuminated push-button switch for rear mounting in an operating panel, comprising a support plate, which has arranged thereon a switching means for triggering a switching operation, a touch element for operating said switching means and a light source for checking said switching operation, wherein the touch element is a lever which is an L-shaped angled member provided with one shorter arm and with one longer arm, the touch element being adapted to be moved relative to the support plate and wherein the shorter arm is supported on said support plate, and that the light source is arranged below the longer arm, said touch element being provided with a light exit opening arranged in the longer arm above the light source and a transparent push-button arranged in said light exit opening whereby at least the light source can be exchanged from the back of the support plate and wherein the push-button projects beyond the surface of the longer arm above the light exit opening and in comparison with said light exit opening said push-button has a larger, especially circular cross-section, and below the light exit opening, said push button fully covers the light source.

2. An illuminated push-button switch according to claim 1, characterized in that the lever is constructed as a lever which is supported at one side thereof.

3. An illuminated push-button switch according to claim 2, characterized in that the shorter arm is supported such that it extends at right angles to the support plate.

4. An illuminated push-button switch according to claim 3, characterized in that by means of two tongue-like extensions, the shorter arm is clamped in position in openings provided in the support plate.

5. An illuminated push-button switch according to any one of claims 1, 3 or 4, characterized in that the longer arm is arranged such that it abuts a back surface of the operating panel, said operating panel being provided with an opening, which is adapted to a cross-sectional surface of the push-button.

6. An illuminated push-button switch according to claim 5, characterized in that the switching means is provided with a spring element which has arranged thereon the touch element, said spring element being adapted to be used for triggering the switching operation when it is in its biased condition.

7. An illuminated push-button switch according to any one of the claims 1, 3 or 4, characterized in that the switching means is provided with a spring element which has arranged thereon the touch element said spring element being adapted to be used for triggering the switching operation when it is in its biased condition.

8. An illuminated push-button switch according to claim 7, characterized in that the longer arm of the touch element has a free end, arranged on the spring element of the switching means.

9. An illuminated push-button switch according to claim 8, characterized in that the end of the longer arm arranged on the switching means is provided with a pin, which engages an adequate recess of the switching means and which is adapted to be moved relative thereto.

10. An illuminated push-button switch according to any one of the claims 1, 3 or 4, characterized in that the push-button has a curved surface, which is adapted to the form of a finger-tip.

11. An illuminated push-button switch according to any one of claims 1, 5, or 6 is a collective lens for supplying the maximum amount of light to the panel from the light source.

12. An illuminated push-button switch according to any one of the claims 1, 3 or 4, characterized in that a second arm, which corresponds to the longer arm of the touch element and which extends diametrically thereto, is arranged on said shorter arm such that it is essentially perpendicular thereto, a switching means and a light source being arranged below said second arm in a corresponding manner.

* * * * *

UNITED STATES PATENT AND TRADEMARK OFFICE

CERTIFICATE OF CORRECTION

PATENT NO. : 5,188,220

DATED : February 23, 1993

INVENTOR(S) : Schmitt-Walter

It is certified that error appears in the above-identified patent and that said Letters Patent is hereby corrected as shown below:

On the title page:

Item "[76]", line 2, "Diesenhofen" should read --Deisenhofen--;

and

Claim 1, column 7, line 57, "touch element" should read --longer arm--.

Claim 11, column 8, line 5, "5, or 6" should read --3, or 4--.

Signed and Sealed this

Twenty-fifth Day of January, 1994

Bruce Lehman

BRUCE LEHMAN

*Commissioner of Patents and Trademarks*

*Attest:*

*Attesting Officer*